US006982521B2

(12) United States Patent
Rodriguez et al.

(10) Patent No.: US 6,982,521 B2
(45) Date of Patent: Jan. 3, 2006

(54) VISUAL DISPLAY WITH CATHODE PLATE CONNECTED TO A SEPARATE BACKPLATE

(76) Inventors: Ingemar V Rodriguez, 13716 Fontanelle Pl., San Diego, CA (US) 92128; William P Bischoff, 1874 Lindsley Park Dr., San Marcos, CA (US) 92069

( * ) Notice: Subject to any disclaimer, the term of this patent is extended or adjusted under 35 U.S.C. 154(b) by 446 days.

(21) Appl. No.: 09/872,723

(22) Filed: Jun. 1, 2001

(65) Prior Publication Data

US 2002/0044130 A1 Apr. 18, 2002

Related U.S. Application Data

(60) Provisional application No. 60/208,710, filed on Jun. 1, 2000.

(51) Int. Cl.
*H01J 1/62* (2006.01)

(52) U.S. Cl. ..... 313/495; 313/491; 445/24; 445/25

(58) Field of Classification Search ..... 313/495, 313/483, 500, 503, 512, 506, 491, 496; 445/25, 445/24
See application file for complete search history.

(56) References Cited

U.S. PATENT DOCUMENTS 5,614,781 A * 3/1997 Spindt et al. ..... 313/422
5,672,083 A 9/1997 Curtin et al. ..... 445/25
5,730,636 A 3/1998 Stansbury ..... 445/25
5,766,053 A 6/1998 Cathey et al. ..... 445/25
5,827,102 A 10/1998 Watkins et al. ..... 445/25
5,997,378 A 12/1999 Dynka et al. ..... 445/25
6,104,135 A 8/2000 Stansbury ..... 313/495
6,274,978 B1 8/2001 Roach et al. ..... 313/483
6,577,057 B1 * 6/2003 Yamamoto et al. ..... 313/495

FOREIGN PATENT DOCUMENTS

WO 9917329 4/1999
WO 9917330 4/1999

* cited by examiner

*Primary Examiner*—Karabi Guharay
*Assistant Examiner*—Sikha Roy
(74) *Attorney, Agent, or Firm*—Alfred A. Fressola; Ware, Fressola, Van Der Sluys & Adolphso LLP

(57) ABSTRACT

A visual display has a cathode plate 101, having an emission layer 102 built up on a ceramic front layer. It has a thicker foundation layer 103. Vias from the front layer have their pitch fanned out to that of the cathode-plate back-layer vias 104. Other main components of the visual display are a frame 111, a back plate 112 and an anode 114 plate. The back plate and the frame are integrally formed of a number of layers of tape cast ceramic material. The back plate has a via and interconnect fan-out. The frame also has a via and interconnect arrangement for making electrical connection to the anode plate.

23 Claims, 2 Drawing Sheets

VISUAL DISPLAY WITH CATHODE PLATE CONNECTED TO A SEPARATE BACKPLATE

This application claims the benefit of U.S. Provisional Application No. 60/208,710 filed Jun. 1, 2000.

TECHNICAL FIELD

The present invention relates to a visual display, particularly though not exclusively for use with data processing apparatus.

BACKGROUND OF THE INVENTION

In prior International patent application, No. PCT/US98/20813, published on 8$^{th}$ Apr. 1999 under No. WO 99/17330 ("The Earlier International Application") we described and claimed.

a field effect emission device for a visual display comprising:

a substrate and an emission layer on one face of the substrate, the emission layer having:

a multiplicity of emitters and gates, arranged as an array of emission pixels and conductive connections in the emission layer to the emitters and the gates, the substrate having:

conductive vias provided through the substrate or at least a front layer thereof to at least some of the said conductive connections in the emission layer for electrical connection to their emitters and gates.

In this specification, we refer to the type of field emission device described in The Earlier International Application as the Front-Layer-Via FED Device.

SUMMARY OF THE INVENTION

We have now developed farther both the device and the display incorporating the device.

According to the present invention a visual display comprising:

a cathode plate in the form of a field effect emission device including a substrate and an emission layer on one face of the substrate, the emission layer having;

a multiplicity of emitters and gates, arranged as an array of emission pixels and conductive connections in the emission layer to the emitters and the gates;

the substrate having:

conductive vias provided through the substrate or at least a front layer thereof to at least some of the said conductive connections in the emission layer for electrical connection to their emitters and gates and an anode plate;

wherein it includes:

a back plate, the cathode plate being carried on the front side of the back plate; and a frame connecting the back plate to the anode plate.

Usually the frame will extend peripherally around the cathode plate.

Whilst it is envisaged that the frame may be constructed as a separate member and then jointed to the back plate, as by frit sealing; in the preferred embodiment, the back plate and the frame are a single structure. In this case, the frame is essentially distinguishable from the back plate as that part of the structure extending further towards the anode plate from the main body of the structure which constitutes the back plate. The frame and the back plate can be laminated from multiple layers of ceramic material. The layers are laminated together in the green state and fired together to unify them into a single structure.

Where as is preferred, the back plate is pressure tight to atmospheric pressure, this arrangement has the advantage that atmospheric pressure does not act on the back of the cathode plate, but acts only on the back of the back plate and on the front of the anode to place the frame joint(s) under compression. Further, the back of the cathode plate is isolated from atmospheric pressure and the joint between the cathode plate and the back plate is not subject to tension due to the interior of the display being evacuated.

For electrical connection of the anode, the frame also preferably incorporates a network of vias extending from one layer to the next and interconnection tracks at interfaces between the layers.

The substrate of the cathode plate may be a multilayer substrate having a front substrate layer and at least one additional substrate layer, with conductive vias provided through the front layer and the or each additional layer and with electrical interconnection tracks at at least some of the interface(s) between adjacent layers so arranged that a front layer via is offset from a via in a back one of the additional layer(s) to which it is electrically connected by the interconnection tracks. Nevertheless, it is conceivable that the substrate would be comprised of or include two layers with vias in one aligned with vias in the next. It is also envisaged that the substrate may have only a single layer, with the emission layer built up on it.

We envisage that, in accordance with a feature described in the co-pending U.S. provisional patent application Ser. No. 60/208776, dated 1$^{st}$ Jun. 2000, ("The Co-pending Application") the cathode plate will usually include a thick ceramic foundation layer usually with one or more additional thinner ceramic layers laminated to one or other side of the thicker, foundation layer. The last two features of the preceding paragraph are conveniently effected in combination with a foundation layer.

The back plate also will usually include a thick foundation layer with additional layer(s) laminated to either or both sides thereof. Again the layers will have vias whereby their pitches fans out towards the back layer; with vias in the front layer of the back plate being offset from those in the back layer thereof. Normally, a greater degree of fan out will occur in the back plate than in the front plate.

For connection to the cathode plate, the back plate preferably has vias in a front layer positioned to connect with vias in the back layer of the cathode plate, possibly with the interposition of connection tracks on either or both of the back plate front layer or the cathode plate back layer.

The vias or the tracks on either or both of these layers may be provided with reflowable solder deposits or with a ball grid array. The solder deposits can be reflowed to provide electrical contact between the two components. Alternatively, the ball grid array comprises an array of balls welded to the vias on one side and pressed on assembly of the cathode plate to the back plate into the vias or connection tracks on the other side.

To isolate the thin gap between the face plate and the back plate from the front side of the cathode plate, a flowable connection is made around the back edge of the cathode plate to the back plate. The connection can be by solder or frit.

Preferably the solder for electrical connection and the solder or the frit for edge sealing has a melting point above 300° C. and preferably above 320° C. This permits heat soaking of the cathode and back plate assembly in vacuum at 300° C. for out-gassing, i.e. removal of gases after connection of the cathode plate and prior to sealing of the anode plate to the carrier. Preferably this latter sealing is carried out at a temperature close to 300° C., typically 290° C., to enable further soldering operations, such as connection of driver and power supply components to the back face of the back plate, to be carried out subsequently with a lower melting point solder.

For assembly of the cathode plate to the back plate in correct position for electrical connection, bearing in mind that the cathode plate is unlikely to be provided with margins that can be gripped, at least when an array of cathode plates is abutted together in a sizeable display, the back plate can be provided with apertures for handling pins. The back side of the cathode plate has recesses in register with the apertures, whereby the pins extend through the apertures to engage in the recesses. The cathode plate can then be lowered onto the back plate. After, or on reflow of the cathode securing solder/frit, the apertures can be plugged. The operations including the lowering of the cathode plate and plugging of the apertures can be carried out under vacuum to avoid the necessity of having to evacuate the inter-plate space through the small apertures.

BRIEF DESCRIPTION OF THE DRAWINGS

To help understanding of the invention.

BEST MODE FOR CARRYING OUT THE INVENTION

Figure 1:
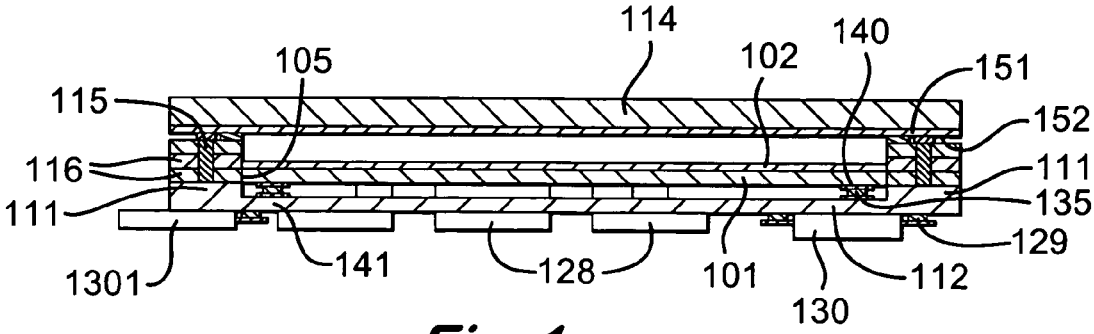
FIG. 1 is a cross-sectional side view of a visual display of the invention.
Figure 2:
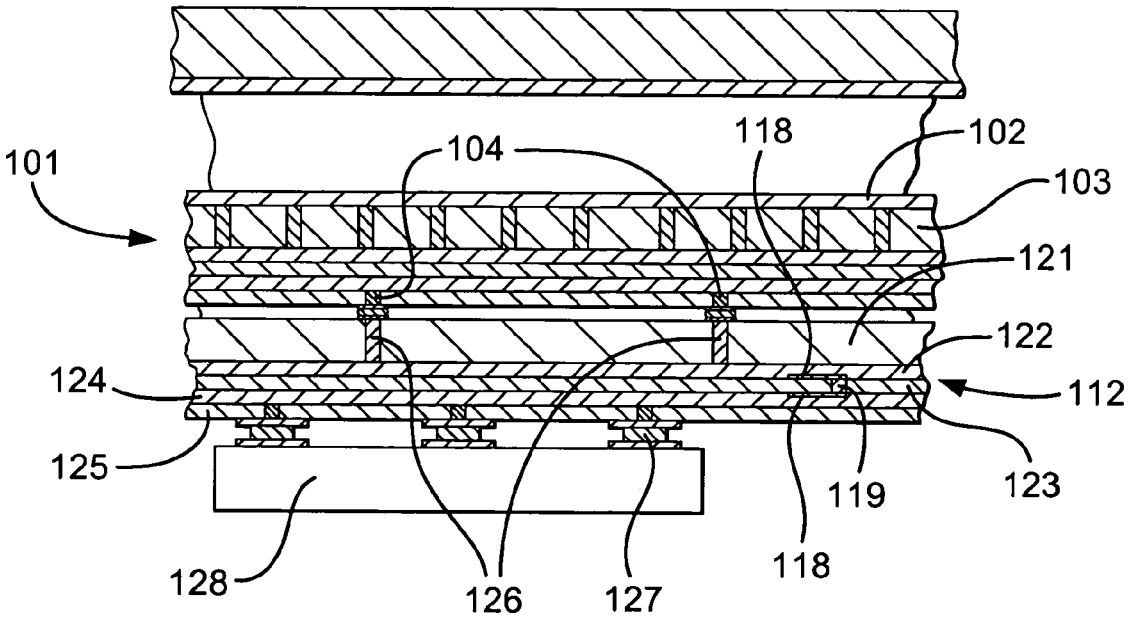
FIG. 2 is a scrap cross-sectional view on a larger scale showing the layers of the cathode plate and of the back plate.
Figure 3:
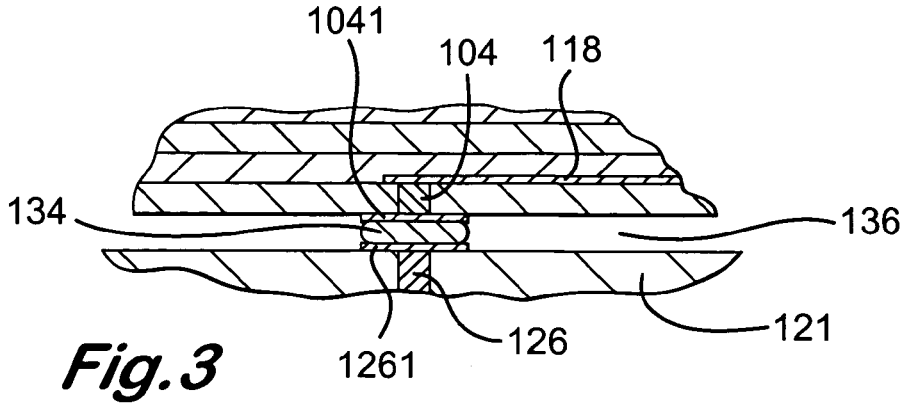
FIG. 3 is a scrap view on an even larger scale showing inter-via connection between the cathode plate and the back plate.
Figure 4:
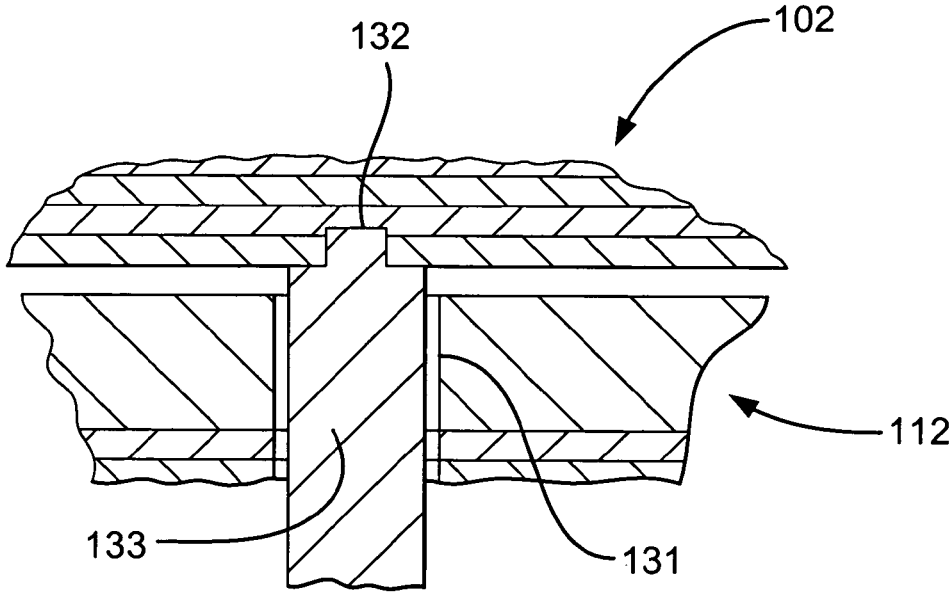
FIG. 4 is a similar view of a pin arrangement for lowering the cathode plate onto the back plate.
Figure 5:
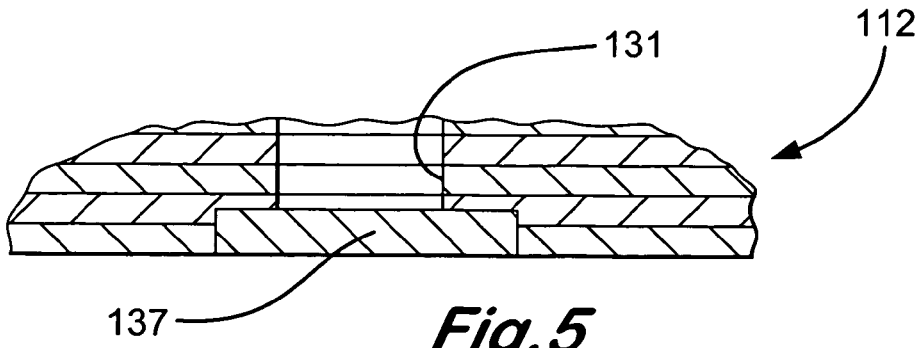
FIG. 5 is a similar view of a frit plug in a lowering aperture.

Referring to the drawings, the visual display there shown has a cathode plate 101, which is a Front-Layer-Via FED Device having an emission layer 102 built up on a ceramic front layer. It has a thicker foundation layer 103, as described in The Co-pending Application. Vias from the front layer have their pitch fanned out to that of the cathode-plate back-layer vias 104.

Other main components of the visual display are a frame 111, a back plate 112 and an anode 114 plate, which latter will not be described in detail in this application, since its structure forms no part of this invention, The back plate and the frame are integrally formed of a number of layers of tape cast ceramic material. The back plate has a via and interconnect fan-out arrangement described in more detail below. The frame also has a via and interconnect arrangement for making electrical connection to the anode plate.

The front layer 121 of the back plate is a foundation layer, which is thicker than the other layers, typically 0.030" thick as against 0,006". There are four thinner back layers 122, 123, 124, 125. The front layer has a pattern of vias 126, which corresponds in layout to that of the cathode plate vias 104. The sequence of manufacture of the back plate is that the thick layer is tape cast and fired. Its via apertures are laser cut and filled with via material. This can be resistive, also as described in The Co-pending Application. The back layers are tape cast onto a mylar layer. The via apertures are filled to form vias 119 and interconnection tracks 118 are screen printed onto the layers, typically of silver paste. The back layers are then assembled to the foundation layer, with the assembly being pressed together temporarily hold it together. Again, the method is analogous to that described in The Co-pending Application in respect of the cathode plate.

Similarly the layers 116 constituting the frame are built up and laid on the periphery of the margin of the back plate. They have vias 115, which are conveniently aligned from one layer to the next. The entire back plate/frame structure is then fired. Although on firing, it will shrink in the Z direction, its X/Y dimensions will remain those of the pre-fired foundation layer. Thus the pitch of the front layer vias 126 remains that at which they were formed, whereby they align with the cathode plate vias 104.

Again as described in The Co-pending Application, the vias in the back face of the back plate are provided—after firing—with a ball grid array 127 for assembly of driver chips 128. Also provided on the back face are screen printed contact pads 129 for surface mount power supply components 130 and a video input connection 1301.

Around each via, a contact pad 1041 of screen printed silver may have been provided prior to lamination and firing of the cathode plate. Also around the margin of the back face of the cathode plate, a continuous peripheral strip of screen printed silver 140 is similarly provided. The front face of the front layer of the back plate is provided with complementary pads 1261 and continuous marginal strip 141. For electrical connection of the cathode, immediately prior to introduction of the cathode plate into a sealing machine, or at an earlier stage in its preparation, flux is screen printed onto its back face around each via 104 and along the strip 140. The plate is dipped in solder powder, which adheres to the flux. The solder is heated to fuse into balls on each pad and on the strip. Conveniently this can be done by diffuse infra red radiation or by laser irradiation to the exact positions of the adhered solder. It is chosen to have a melting point in excess of 320° C. The solder forms balls 134 on the vias and their contact pads and a continuous ridge 135 along the strip 140.

Alignment of the cathode plate and the back plate is critical for proper via alignment and connection. A set of alignment pin apertures 131 is provided in the back plate, with corresponding blind recesses 132 in the back of the cathode plate. On assembly, pins 133 arranged in the sealing machine are introduced through the apertures 131, the cathode plate is placed on the pins with their ends engaging in the recesses, The cathode is then lowered into position, by withdrawal of the pins. Final positioning of the cathode plate is determined by abutment of its edges 105 with the inside of the frame 111.

After the cathode has been lowered onto the back plate, and the two components are heated to say 325° C., where the solder melts at 320° C. The solder balls wet the opposite via pads and connect respective vias 104, 126. Similarly, the solder ridge 135 melt and wet the opposite strip 141. Thus this peripheral solder joint seals the thin space 136 between the components from the space to be evacuated in front of the cathode plate. This soldering of the vias and the peripheral margin is anticipated to be feasible without fluxing the pads 1261 and strip 141 on the back plate, since they will be kept clean since formation. This is of advantage, since fluxing of the strip 141, in the corner between the frame and the front of the back plate is awkward to access. However, should fluxing be necessary the pads and strip can be fluxed and coated with powdered solder to further enhance the solder joints.

The positioning and soldering of the cathode plate can be carried out in atmospheric conditions. However, it is preferably carried out in a vacuum chamber of a sealing machine. In either case, the next operation—performed under vacuum—is the sealing of the apertures 131, for instance by introduction of frit plugs 137 into them and fusing of the frit by means of a laser.

After evacuation and sealing of the space 136 between the cathode plate and the back plate, the vacuum level in the processing chamber is increased and the assembly is heat soaked at 300° C. to remove as much gaseous material as possible. With the space 136 already sealed, difficulties in evacuation of this confined space are avoided. The step of high level evacuation and heat soak is carried out with the anode plate already introduced into the chamber.

Previously, a margin of frit 151 has been deposited on the front edge 152 of the frame, and solder has been deposited onto vias 115 to ITO/phosphor lines on the inside surface of the anode plate 114. This solder is such as to melt at just below 300° C., typically Indium 290, which melts at 290° C. The anode plate is lowered onto the frame, with the solder wetting the phosphor line contacts. The frit is fused by laser traverse as described in The Earlier International Patent Application (and claimed in its sister application No. WO 99/17329), sealing the anode plate to the frame.

The thus assembled display is ready for use when its drivers, power supply components and video input connectors are connected to it The latter two 130, 1301 are soldered onto the contact pads 129. This is by means of a solder melting below 290° C. to avoid disturbance of the electrical connection to the phosphor lines and indeed connection of the cathode plate to the back plate. The drivers are connected by ball grid array techniques, which are within the capabilities of the man skilled in the art and will not be described in detail here.

The invention is not intended to be restricted to the details of the above described embodiment, for instance, in place of the peripheral solder seal, a margin of frit is screen printed onto the back face of the cathode plate or the front face of the back plate. The frit is chosen to melt at the same temperature as the inter-via solder, whereby the two materials fuse at the same time, Further, where the vias are of a material readily wetted by the solder, the contact pads at the vias can be dispensed with. Furthermore, where there is a possibility of flux resulting in unwanted vapours inside the sealed display, its use is now preferred to be dispensed with and fluxless solder used instead, particularly between the back plate and the cathode plate. Again, in place of the use of frit between the anode plate and the frame, solder, such as indium solder, can be used. This can be fused by heat soaking or by laser traverse, as described in The Earlier International Patent Application.

What is claimed is:

1. A visual display comprising:

a cathode plate in the form of a field effect emission device including:

a substrate and an emission layer on one face of the substrate, the emission layer having:

a multiplicity of emitters and gates, arranged as an array of emission pixels and conductive connections in the emission layer to the emitters and the gates;

the substrate having:

first conductive vias provided through the substrate or at least a front layer thereof to at least some of the said conductive connections in the emission layer for electrical connection to their emitters and gates and second conductive vias depending from a back layer of the cathode plate, and an anode plate; characterised in that it includes:

a separate back plate, wherein the cathode plate back layer is carried on the front side of the back plate, the back plate being continuous across the back side of the cathode plate; and a frame connecting the back plate to the anode plate; and further wherein for connection to the cathode plate, the back plate has vias in a front layer positioned to connect via solder connections with the second vias depending from the conductive back layer of the cathode plate.

2. A visual display according to claim 1, wherein the frame extends peripherally around the cathode plate.

3. A visual display according to claim 1, wherein the frame is constructed as a separate member and then jointed to the back plate.

4. A visual display according to claim 3, wherein the frame is joined to the back plate by frit sealing.

5. A visual display according to claim 1, wherein the frame and the back plate are provided as a single structure, the frame being distinguishable from the back plate as that part of the structure extending further towards the anode plate from a main body of the structure which constitutes the back plate.

6. A visual display according to claim 1, wherein the frame and the back plate are laminated from multiple layers of ceramic material.

7. A visual display according to claim 6, wherein the layers are laminated together in the green state and fired together to unify them into a single structure.

8. A visual display according to claim 1, wherein the back plate is pressure tight to atmospheric pressure, whereby atmospheric pressure acts only on the back of the back plate and on the front of the anode to place joint(s) between the frame and the plates under compression.

9. A visual display according to claim 1, wherein, for electrical connection of the anode, the frame incorporates a network of vias extending from one layer to the next and interconnection tracks at interfaces between the layers.

10. A visual display according to claim 1, wherein the substrate of the cathode plate is a multilayer substrate having a front substrate layer and at least one additional substrate layer, with conductive vias provided through the front layer and the or each additional layer and with electrical interconnection tracks at least some of the interface(s) between adjacent layers so arranged that a front layer via is offset from a via in a back one of the additional layer(s) to which it is electrically connected by the interconnection tracks.

11. A visual display according to claim 1, wherein the substrate of the cathode plate is a multilayer substrate having a front substrate layer and at least one additional substrate layer, with conductive vias provided through the front layer and the or each additional layer and with electrical interconnection tracks at least some of the interface(s) between adjacent layers so arranged that the substrate includes two layers with vias in one aligned with vias in the next.

12. A visual display according to claim 1, wherein the substrate of the cathode plate is a substrate having only a single layer, with the emission layer built up on it.

13. A visual display according to claim 1, wherein the cathode plate includes a thick ceramic foundation layer with one or more additional thinner ceramic layers laminated to one or other side of the thicker, foundation layer.

14. A visual display according to claim 1, wherein the back plate includes a thick foundation layer with additional layer(s) laminated to either or both sides thereof.

15. A visual display according to claim 14, wherein the back plate layers have vias whereby their pitches fan out towards a back layer, with vias in the front layer of the back plate being offset from those in the back layer thereof.

16. A visual display according to claim 1, including connection tracks on either or both of the back plate front layer or the cathode plate back layer, further wherein said connection tracks are connected by solder to connection tracks or vias on the back plate front layer or the cathode plate back layer.

17. A visual display according to claim 16, wherein the vias or the tracks on either or both of the back plate front layer or the cathode plate back layer are connected by a ball grid array.

18. A visual display according to claim 1, including a flowable connection made around the back edge of the cathode plate to the back plate to isolate a thin gap between the cathode plate and the back plate.

19. A visual display according to claim 18, wherein the flowable connection is of solder or frit.

20. A visual display according to claim 18, wherein the vias or the tracks on either or both of the back plate front layer or the cathode plate back layer are connected by solder and the solder for electrical connection and the solder or the frit for edge sealing has a melting point above 320° C.

21. A visual display according to claim 1, wherein the anode plate is sealed to the frame by a fused frit seal.

22. A visual display according to claim 1, wherein the anode plate is sealed to the frame by a fused solder seal.

23. A visual display comprising:

a cathode plate in the form of a field effect emission device including:

a substrate and an emission layer on one face of the substrate, the emission layer having:

a multiplicity of emitters and gates, arranged as an array of emission pixels and conductive connections in the emission layer to the emitters and the gates;

the substrate having:

conductive vias provided through the substrate or at least a front layer thereof to at least some of the said conductive connections in the emission layer for electrical connection to their emitters and gates and an anode plate;

characterised in that it includes:

a back plate, the cathode plate being carried on the front side of the back plate; and a frame connecting the back plate to the anode plate;

wherein, for assembly of the cathode plate to the back plate in correct position for electrical connection:

the back plate is provided with apertures for handling pins, the apertures being plugged in the finished display and the back side of the cathode plate is provided with recesses for the handling pins in register with the apertures.

* * * * *

UNITED STATES PATENT AND TRADEMARK OFFICE

CERTIFICATE OF CORRECTION

PATENT NO. : 6,982,521 B2
DATED : January 3, 2006
INVENTOR(S) : Rodriguez et al.

It is certified that error appears in the above-identified patent and that said Letters Patent is hereby corrected as shown below:

Column 1,
Line 38, insert -- : -- after "claimed".
Line 44, insert -- : -- after "including".

Column 3,
Line 60, delete "," and insert -- . --.

Column 4,
Line 55, delete "," after "recesses" and insert -- . --.

Column 5,
Line 35, insert -- . -- after "it".
Line 49, delete "," after "time" and insert -- . --.

Signed and Sealed this

Twenty-first Day of March, 2006

JON W. DUDAS
*Director of the United States Patent and Trademark Office*